United States Patent [19]

Wilkinson

[11] 4,075,372

[45] Feb. 21, 1978

[54] FLEXIBILITY ENHANCING COATING FOR BOXBOARD, PARTICULARLY OF CARTON JOINTS AND FOLD LINES, AND METHOD OF APPLICATION

[75] Inventor: Robert M. Wilkinson, Florissant, Mo.

[73] Assignee: Alton Box Board Company, Alton, Ill.

[21] Appl. No.: 572,878

[22] Filed: Apr. 29, 1975

[51] Int. Cl.[2] ..... B05D 1/38; B32B 29/06; B32B 3/02

[52] U.S. Cl. ..... 427/258; 427/290; 427/324; 427/326; 427/390 E; 427/391; 428/165; 428/172

[58] Field of Search ..... 427/411, 289, 290, 428, 427/258, 290, 324, 326, 396, 391; 428/511, 514, 156, 165, 172

[56] References Cited

U.S. PATENT DOCUMENTS

| | | | |
|---|---|---|---|
| 3,260,690 | 7/1966 | Bohnert et al. | 428/511 X |
| 3,305,383 | 2/1967 | Gordy | 427/411 X |
| 3,476,587 | 11/1969 | Demol et al. | 427/411 X |
| 3,707,393 | 12/1972 | McDonald | 427/411 X |
| 3,770,486 | 11/1973 | Hopermann | 427/160 |

*Primary Examiner*—James R. Hoffman
*Attorney, Agent, or Firm*—Paul M. Denk

[57] ABSTRACT

An improvement in enhancing the moisture attributes of boxboard and paperboard, a coating of a flexible film forming material is applied preferably by means of a printing roller to the surface of said boxboard before any moisture barrier lacquer is applied to the same.

9 Claims, No Drawings

FLEXIBILITY ENHANCING COATING FOR BOXBOARD, PARTICULARLY OF CARTON JOINTS AND FOLD LINES, AND METHOD OF APPLICATION

BACKGROUND OF THE INVENTION

This invention relates generally to improving the resistance of boxboard and paperboard to moisture absorption, and more particularly pertains to the application of a flexible film intermediate the surface of paperboard and the usual moisture retarding lacquer that is customarily applied thereto.

The paper and paperboard industry has long experimented and improved various methods for making paper products more resistant to the absorption of moisture, and this is particularly so where the materials are eventually folded into cartons and containers for use in the marketing of various foods, domestic and other chemical products. More specifically, the moisture retarding method and means for enhancing the attributes of paper usually entailed simply the coating of the moisture barrier lacquer directly to the paper product, generally incident to the initial manufacture of the paper, and if the paper was to be used in that particular initial configuration, then its moisture retarding attributes would generally be sufficient and beneficial during that usage. But, as is well known in the trade, such manufactured paper, particularly when it is further processed into packages or cartons, is almost without exception subsequently scored, or impressed with fold lines, and then folded by appropriate machinery into the configuration of cartons for support of enumerable products.

As an example of the foregoing, the patent to Hopermann, U.S. Pat. No. 3,770,486, discloses a method for preparing a moisture resistant packaging material which is generally formed by first applying a primer composition of a vinyl halide, vinylidene chloride, or a chlorinated rubber, to the surface of the material initially for sealing the pores of the packaging material to provide a pre moisture resistant coating. Then, after that coating is dried, a top lacquer coating of a cyclized natural rubber is applied to insure a reduction of moisture absorption into the paper. This prior art method is apparently effective for its intended operation, but, the applicant has found that when this prior art method is used on boxboard, subsequent bending or folding of the treated materials when folded into the configuration of a packaging material that significant fractures occur to the various coatings within the vicinity of the fold lines that substantially reduces, if not destroys, any barrier against moisture absorption of the finished container. It is believed that the inability of the identified primercoats to elongate is what causes the fractures to occur.

In fact, and further expanding upon the foregoing, tests have been conducted on packaging materials that have been treated according to the Hopermann method, as for example where Hopermann describes in Part C of its specification that the moisture vapor transmission rate had been subsided in his coated board down to a rate in the vicinity of 1.2 grams of water vapor per 100 square inches of treated board per 24 hours, that identical tests run upon the Hopermann board, that had been both scored and then folded, greatly accelerated its moisture absorbing characteristics as follows:

WATER VAPOR TRANSFER RATE-GRAMS/100 SQUARE INCHES/24 HOURS

| | Hopermann Coating |
|---|---|
| Vertical Score Line Folded 180° | 35.9 |
| Horizontal Score Line Folded Back 90° Folded Forward 180° | 12.6 |

Thus, it can be seen that if the prior arts original estimate, if actually proven, moisture vapor transmission rate was found to be 1.2 grams, then where the board was subsequently scored and then folded its moisture absorption was significantly increased by 2160% and 4170% respectively, as shown in each test instance. Hence, tests conducted on the Hopermann method having conclusively proven that its method is of little or no value where score lines and fold lines are subsequently made to the coated board.

Another prior art invention having some relevancy with respect to the present invention is in the U.S. patent to McDonald, U.S. Pat. No. 3,707,393, wherein is discussed the concept of adding a precoat or undercoat to the interior side of the paper, with said precoat comprising a co-polymer of ethylene and carboxylic acid. Then, a top coat of polyvinylidene chloride is also applied as an outside coating to the paper or sheet material. It is believed that the McDonald method for treating sheet material is probably used for the coating of paper, such as paper customarily used for holding food products such as potato chips, or other snack food products, and of the type that generally exhibit a form of grease barrier on the inside of a bag so as to prevent the oily film of the snack from penetrating to the exterior of the bag, and likewise to prevent any moisture from attaining entrance into the bag so as to maintain the crispness of the product contained therein. In any event, and for reasons which will be subsequently analyzed in the summary of the present invention, applicants invention utilizes a directly opposite method for coating boxboard products, in addition to one which significantly enhances the moisture absorbing barrier characteristic of such board.

It is therefore, the principal object of this invention to provide a precoating having significant elongation attributes, used as a precoating to the moisture barrier lacquer customarily applied as a coating to the boxboard and related paperboard products.

It is another object of this invention to provide a precoat for the standard moisture barrier lacquers applied to boxboard products, the purpose of the precoat being to provide resistance to fracture of said exterior lacquer during its folding or bending into the configuration of a carton.

It is a further object of this invention to provide a flexible precoat for the lacquer applied to paperboard products having the ability to stretch at least a 250 percent of its initial constitution and thereby avoid severing during the boxboard folding, or fracturing of the lacquer applied to the exterior surface.

A further object of this invention is to provide a flexible precoat having significant elongation attributes and which thereby helps to prevent any fracturing to the moisture barrier applied externally to paperboard.

Another object of this invention is to provide a precoat for boxboard having enhanced flexibility and which may be applied either before or after printed matter is gravured onto the board surface.

An additional object of this invention is to provide a flexible precoat for paperboard that will not be cut or fractured when fold lines are impressed onto its surface.

A further object of this invention is to provide a container formed from boxboard that has enhanced moisture retarding attributes due to the application of a flexible precoat initially to its surface.

A further object of this invention is to provide a vinyl resin precoat for boxboard which, after the application of a moisture barrier lacquer, reduces the water vapor transfer rate through the board, and particularly along its fold lines, by as much as one hundred times as compared to prior art lacquer coatings.

Another object of this invention is to provide an ionomer resin dispersion of an ethylene interpolymer as a precoating for boxboard to enhance the stretchability of any moisture barrier lacquer subsequently applied thereto before folding of the boxboard into the configuration of a carton.

These and other objects will become more apparent to those skilled in the art upon reviewing the following summary of this invention.

SUMMARY OF THE INVENTION

The essence of this invention is the provision of a flexible coating to the intended exterior surface of particularly boxboard, or other paperboard products. This is done before any moisture barrier lacquer is applied to the same surface, and further before any folding or bending is made of the boxboard into the configuration of the desired carton. It should be commented herein that reference to boxboard is not meant to be interpreted as exclusive of other types of paper products, nor is it meant to define only carton boxboard, but rather, is herein defined as any form of paper product that has sufficient rigidity to allow for its eventual scoring or impressing with fold lines for folding into the configuration of carton or container for holding various products. Hence, it is not the essence of this invention that it be applied to highly flexible paper that may be used in the formation of bags, but on the other hand, and as previously stated, the invention is not solely for use upon just boxboard, although this is the preferred embodiment. The invention is also designed for use upon other thickened paperboard that are customarily folded into the form of containers for use in holding a variety of food products, such as breakfast cereals or the like, or perhaps frozen food products, where it is desired that little or no external moisture attains entrance into and contact with the foods disposed therein. Powdered or flaked soap products also generally fit into the category of domestic products that are desirably marketed in the style of treated container board as described in this invention.

Essentially, the invention contemplates the application of a flexible precoat in the category of a thermoplastic resin to the exterior surface of the boxboard, either before or after the printed matter is applied to said board, with a final application of the usual style of moisture prohibiting lacquer overlying all of the foregoing to prevent moisture absorption into the interior of the finished carton. Preferably, the flexibility of the resin undercoating provides an excellent film for supporting the more handenable lacquer, and alleviates the latter's cracking and fracturing particularly along the dimension of any scored or folded areas to be and when made to the board. Preferably, the flexible film forming material that is precoated to the paperboard surface is selected from a group of vinyl resins, as in the category of polyvinyl acetate, ethylene vinyl acetate, ethylene vinyl chloride, or any of their co-polymers, and such is applied by means of a gravure roll to the surface of the boxboard. Also found desirable is a precoating of an ionomer of an ethylene interpolymer which has utility as a stretchable membrane that is also roller coated onto the surface of boxboard. As previously commented, the board surface may have been preprinted with printed matter, or the printed matter may have been rolled onto the surface of the boxboard after this flexible film forming precoating has been applied and dried on the same.

The prime reason for this precoating of the flexible film material to the boxboard surface has already been described, but preferably, and through tests, it has been found that those plastic films that have a percentage of elongation in excess of 350 have been most effective in assisting the lacquer barrier to withstand fracture-free bending around fold lines or along score lines, and to prevent their rupture thereat. It is believed that the inherent flexibility of this undercoat and its thermoplastic softness has a tendency to absorb the shock and stimulate the contour folding of the lacquer coating itself, reducing the sharpness of the bend more to a radius curve of the said lacquer coating by providing conformation between the boxboard fold itself and the exterior applied lacquer coating. In any event, elongation tests made upon various style plastic films has proven that specific thermoplastic coatings in the category of the vinyl resins the defined ionomers have at least the percent elongation characteristic previously defined and function much better as this buffer zone between the boxboard top surface and the more hardenable lacquer exterior coating. The following chart indicates the percent of elongation calculated for various types of plastic films, and even those which are so prominently mentioned in the prior art, and in particular in at least one of the prior art patents analyzed herein. This data was published and presented in a more recent Modern Plastics Encyclopedia, Volume 49, No. 10A, 1972–1973 Edition. The data set forth is as follows:

| PLASTIC FILM | PERCENT ELONGATION |
|---|---|
| Vinylidene Chloride Co-Polymer | 30–80 |
| Vinyl Chloride | 25–50 |
| Acrylonitile | 10–50 |
| Ionomer of Ethylene Interpolymer | 350–450 |
| Ethylene Vinyl Acetate | 500–800 |
| Ethylene Vinyl Chloride | 500–1,000 |

As can be seen, the three latter set forth resins exhibit much greater thermoplasticity that allows for substantially more stretching or elongation of any film formed therefrom, which when acting as the subsidiary substrate for the lacquer moisture barrier coating as applied to the boxboard enhances the latter's functionability to reduce the permeation of moisture into and through the boxboard. It is to be noted that the chemical compounds selected for use as the flexible support for the lacquer barrier of this invention are in the category that exhibit a percent elongation at least above 350, and some of those are substantially even above that as shown in the aforesaid chart.

To further support the advantages achieved from the style of precoat defined in this invention, and its ability to alleviate the cracking and rupturing of the barrier film, particularly in the area of fold or scored lines, the following chart of conducted tests provide excellent support for the beneficial aspects of this invention. The following data should be compared with similar type tests conducted and previously analyzed in the background of this invention, as with respect to the prior art coating process.

| WATER VAPOR TRANSFER RATE-GRAMS/100 SQUARE INCHES/24 HOURS | |
|---|---|
| | Applicant's Coating Under Hoppermann Coating |
| Vertical Score Line Folded 180° | 2.8 |
| Horizontal Score Line Folded Back 90° Folded Forward 180° | 12.6 |

The applicant's coating, in these tests, applied before the prior art type of lacquer comprises the ethylene vinyl chloride, and it obviously has the ability to stretch and bend around the corner of a fold line, to the degrees as shown, with the advantage that it prevented rupturing of the lacquer coating itself, even at the same location. The ethylene vinyl chloride was applied at the rate of 0.25 pounds per thousand square feet of boxboard. The prior art prime lacquer coating utilized, and as described in the patent, comprises the vinylidene chloride co-polymer, and which was applied as the prime coating over the applicant's precoat. In any event, when one compares the vapor transfer rate of only 2.8 grams of this current test, with the vapor transfer rate of 35.9 grams for boxboard treated by the Hopermann method alone, as previously reviewed, it can be seen that the precoat of this invention significantly reduced the vapor transfer rate into and through the treated paperboard, and by as much as 1300 percent, particularly at the location of fold lines. In addition, where a horizontal score line was applied to both specimens, and then folded back and forward the designated degrees, applicant's invention substantially reduced the moisture transfer rate by as much as 400 percent.

The reason for this significant reduction in the transfer rate of moisture through the paperboard treated by the method in the prior art, that which is also supplementally treated by the method this invention, as previously analyzed, is believed due to the fact that, upon inspection, the lacquer coating itself did not crack or fracture even at the location of the score and fold lines, when the inventive precoat had also been applied thereto. Whereas, such fractures were quite apparent along similar score lines of paperboard when folded after treatment with only a lacquer coating as described in the prior art.

The foregoing moisture vapor transfer rate tests were conducted in accordance with the TAPPI standard procedure, T-464, as the established test. It is submitted that no significant differences exist between the National Flexible Packaging Association test procedures, as analyzed in the prior art, and the TAPPI procedures.

An example of the use of the foregoing invention may be as follows. After a sheet of boxboard had been manufactured, its surface was scored and slotted to the dimensions of the container specified. In the continuing process, the printable matter was applied by means of gravure rolls to the specified surface of the board, and, upon its rapid drying, a coating of ethylene vinyl chloride in the amount of 0.25 pounds per thousand square feet of the board was additionally applied over the printed surface of the boxboard also by means of a gravure roll. This coating was dried by application of heat in the range of 215° F. to 350° F. After its drying, a moisture vapor barrier lacquer, in this instance, vinylidene chloride, as known in the art, was applied as an exterior coating at the rate of 0.75 pounds per ream of the board as the final moisture barrier coating. Upon testing this treated board the water vapor transfer rate was reduced down to 0.67 grams per 100 square inches per 24 hours under the TAPPI test. In addition, the same board was scored, and folded, both back and forward, as previously analyzed under earlier vapor transfer rate tests, and provided the greatly reduced moisture absorption rates as previously analyzed when compared to board only treated with the vinylidene chloride alone.

In this specimen run, it was further determined that the ethylene vinyl chloride could have been applied in the amount as low as 0.1 pounds per thousand square feet of board, or as high as 0.6 pounds per thousand square feet of board, and have operated just as effectively as the precoat. Furthermore, and as well known in the art, any variety of moisture vapor barriers other than vinylidene chloride, or its co-polymers, are readily available in the prior art, marketed by the trade, and which include products such as butyl rubber compounds and nitro-cellulose, could be utilized in place of the exterior moisture barrier coating as defined in this example. For example, there are many thermoplastics such as described that are readily available for providing a fixed film coating that is intended for use as a moisture barrier, and which could be utilized in place of the vinylidene chloride; the essence of the present invention being concerned with the style of precoat as analyzed previously in this invention as applied to the board in the range of amounts designated. For example, ethylene vinyl acetate, polyvinyl acetate, or their copolymers, have also been found to function excellently as a support film that alleviates cracking and breaking of the externally applied moisture barrier film even in the area of fold and score lines upon boxboard when folded into the configuration of cartons. These other precoats are effective when applied in the same amounts as set forth for the ethylene vinyl chloride, and function just as well for the intended purposes of this invention.

As further previously reviewed, various types of ionomers that are very resistant to stress cracking have been found to be useful as a precoat applied in the manner as described in this invention. These ionomer resins are polymers which have ethylene also as their major component, and have a very strong interchain iononic force that, apparently, as applied according to the teachings of this invention, renders the coated film very tenacious in holding fast to the boxboard, in addition to providing resilience so as to prevent outer coating fracture during folding of the same into the configuration of a carton. The preferred ionomer comprises a water dispersion of a high molecular weight ethylene interpolymer, that is also applied in the range between 0.1 to 0.6 pounds per thousand square feet of boxboard. Furthermore, after the coating is applied, its drying may be accelerated through the application of heat in an amount of at least above 155° F. One such ionomer is available from the duPont Company of Wilmington, Del., and sold under the terminology Elvax D.

The precoat of the invention can be applied either before the printing ink is applied, or after the same as described herein, and still function just as effectively for its intended purpose.

The herein before described preferred method and embodiment is set forth for illustration purposes only, and any variations or changes analyzed by those skilled in the art in view of the subject matter set forth herein are intended to be encompassed within the claims to patent protection set forth.

Having thus described the invention what is claimed and desired to be secured by Letters Patent is:

1. The method of improving the resistance of boxboard to moisture absorption particularly at its fold areas, comprising the steps of initially coating the intended exterior surface of the boxboard through the use of a printing roller with a dryable flexible film forming material of a thermoplastic resin to form a stretchable membrane thereon, said flexible film forming material of a thermoplastic resin being selected from the group consisting essentially of polyvinyl acetate, ethylene vinyl acetate, ethylene vinyl chloride, and their copolymers thereof, with said flexible film forming material having the characteristic to exceed a percentage of elongation in excess of 350, heating said applied film to achieve its drying, and then applying over said coated film after drying a lacquer exhibiting moisture barrier properties.

2. The method of claim 1 and including applying printed matter to the surface of the boxboard before the application of the flexible film forming material.

3. The method of claim 1 and including applying printed matter to the surface of the flexible film forming material after said material has been coated onto the surface of the boxboard and dried.

4. The method of claim 1 and further including the step of indenting fold lines at patterned locations to the surface of the coated boxboard to facilitate its eventual folding into a carton before the coating of said material thereon.

5. The method of claim 1 and further including the step of scoring the boxboard at predetermined locations to facilitate its eventual folding into the configuration of a carton before the coating of said material thereon.

6. The invention of claim 1 wherein the flexible film forming material is applied to the exterior surface of the boxboard at a rate of between about 0.1 to 0.6 pound per thousand square feet.

7. A boxboard blank having fold lines to facilitate its folding into a carton configuration, a first coating of a dryable flexible film forming thermoplastic material having the characteristic to exceed a percentage of elongation in excess of 350, and selected from the group consisting essentially of polyvinyl acetate, ethylene vinyl acetate, ethylene vinyl chloride, and their copolymers thereof, said material being applied to at least the vicinity of the said carton fold lines, said flexible film forming material being applied at a rate of between about 0.1 to 0.6 pound per thousand square feet of boxboard, said applied flexible film forming material being dried upon the boxboard, a second and exterior coating of a moisture barrier lacquer applied over the dried surface of the said flexible film forming material in the vicinity of at least the said carton fold lines, the combination of said flexible film and lacquer moisture barrier significantly reducing moisture absorption into the interior of the carton after it is formed particularly at the vicinity of its fold lines.

8. The method of improving the resistance of boxboard to moisture absorption particularly at its fold areas, comprising the steps of initially coating the intended exterior surface of the boxboard through the use of a printing roller with a dryable flexible film forming material of a thermoplastic resin comprising an ionomer of an ethylene interpolymer having the characteristic to exceed a percentage of elongation in excess of 350, heating said applied film at least above 150° F to achieve its drying, and then applying over said coated film a lacquer exhibiting moisture barrier properties.

9. A boxboard carton having fold lines to facilitate its folding into its carton configuration, a first coating of a dryable flexible film forming thermoplastic material comprising an ionomer of an ethylene interpolymer, said film forming material being applied exteriorly at least in the vicinity of said carton fold lines, said flexible film forming material being applied at a rate of between about 0.1 to 0.6 pound per thousand square feet of boxboard, a second and exterior coating of a moisture barrier lacquer applied over the surface of said flexible film forming material after it has dried and in the vicinity of at least said carton fold lines, the combination of said flexible film and lacquer moisture barrier significantly reducing moisture absorption into the interior of the carton particularly at the vicinity of its fold lines.

* * * * *